US008152342B2

(12) United States Patent
Jowid

(10) Patent No.: US 8,152,342 B2
(45) **Date of Patent: *Apr. 10, 2012**

(54) LIGHT FIXTURE ASSEMBLY AND METHOD

(76) Inventor: Albert M. Jowid, Dallas, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/983,685

(22) Filed: Jan. 3, 2011

(65) Prior Publication Data

US 2011/0096554 A1 Apr. 28, 2011

Related U.S. Application Data

(63) Continuation of application No. 12/196,545, filed on Aug. 22, 2008, now Pat. No. 7,862,215.

(60) Provisional application No. 60/957,803, filed on Aug. 24, 2007, provisional application No. 60/971,628, filed on Sep. 12, 2007.

(51) Int. Cl.
*F21V 21/00* (2006.01)

(52) U.S. Cl. ..... 362/374; 362/145; 362/408; 362/433

(58) Field of Classification Search ..... 362/145–151, 362/403, 408, 431, 436, 438, 440, 453, 455, 362/396

See application file for complete search history.

(56) References Cited

U.S. PATENT DOCUMENTS 2,639,368 A 5/1953 Pryne
2,673,366 A 3/1954 Moss
5,980,068 A 11/1999 Yu
6,312,145 B1 11/2001 Rhoad
6,364,511 B1 4/2002 Cohen
6,565,230 B2 5/2003 Ashley
6,632,006 B1 * 10/2003 Rippel et al. ..... 362/366
6,814,471 B1 11/2004 Stoner
7,434,961 B1 10/2008 Bernhardt et al.

OTHER PUBLICATIONS

Get Organized! Catalog, Item. K Fluorescent Light Bulb Cover , Jul. 2008, p. 33.

* cited by examiner

*Primary Examiner* — John A Ward
(74) *Attorney, Agent, or Firm* — Grady K. Bergen; Griggs Bergen LLP

(57) ABSTRACT

A lamp cover assembly for a recessed light fixture assembly is provided. The light fixture has a socket for receiving an electrical light bulb and a canister housing for housing the bulb of the light fixture assembly. The canister housing has an opening for allowing the passage of light through the opening. The lamp cover assembly includes a lens body that is substantially translucent to allow the passage of light through the body and is configured to cover the opening so that the light bulb of the light fixture assembly is generally concealed from view through the opening. A light fixture engagement portion for engagement with the light fixture assembly is provided with the lamp cover assembly so that the lamp cover may be selectively engaged and disengaged from the light fixture assembly. The body of the lamp cover assembly has an outer perimeter that is sized so that the perimeter is spaced radially inward a distance from the edges of the opening of the light fixture assembly when the cover assembly is engaged with the light fixture assembly.

21 Claims, 5 Drawing Sheets

LIGHT FIXTURE ASSEMBLY AND METHOD

CROSS-REFERENCE TO RELATED APPLICATIONS

This application is a continuation of U.S. application Ser. No. 12/196,545, filed Aug. 22, 2008, now U.S. Pat. No. 7,862,215, issued Jan. 4, 2011, and which claims the benefit of U.S. Provisional Application Nos. 60/957,803, filed Aug. 24, 2007, and 60/971,628, filed Sep. 12, 2007, each of which is hereby incorporated herein by reference in its entirety.

BACKGROUND

The recessed can light fixture has been a common household and workplace lighting fixture for many years. Referring to FIG. 1, an example of such a recessed can light fixture assembly 10 is shown. Although the configurations for these fixtures may vary somewhat, the fixture 10 typically includes a cylindrical-shaped canister or housing 12, which may be formed of metal, plastic or other suitable material, that is open at its lower end and that houses or includes a socket or socket assembly 14 located at the upper end of the canister 12. The socket assembly 14 is electrically coupled to an electrical power source (not shown) through wiring of the home or dwelling. The canister 12 is typically mounted so that it is recessed in an opening formed in a panel 16, such as drywall or the like, that forms a ceiling or wall of a room. A trim assembly or baffle 18 may be provided with the light fixture 10. The trim assembly 18 may include a cone 20 that extends a distance into the canister 20 and has a central opening for allowing the passage of light. The cone 20 may be generally concentric with the cylindrical canister 12 and may taper radially outward along its length from its upper end to its lower end, as shown. The interior of the cone 20 may optionally be provided with a reflective surface for reflecting light or a decorative coloring. A circumferential flange or rim 22 that extends radially outward from the lower end of the cone 20 may also be provided with the trim assembly 18 and facilitates providing a finished look to the fixture 10. The trim assembly or baffle 18 may be secured to the canister 12 or light fixture 10 through mounting springs 24 or other suitable coupling mechanisms.

A light bulb or lamp 26 is used with the light fixture 10. Until recently incandescent lamps, including halogen lamps, have been primarily used as the lamps with recessed canned light fixtures, such as the fixture 10. These incandescent lamps are typically spot or flood lights, such as the R30-type and R40-type incandescent lamps, which generally have the configuration of the lamp 26 shown in FIG. 1. Lamps for recessed light fixtures typically employ those bulb shapes designated in the industry as BR, ER, PAR, K and R. These lamps have a socket 28 at one end for electrically coupling to the socket 14 and an opposite illuminating end 30. As shown, the lamp 26 tapers in diameter along its length, with the diameter gradually increasing to its greatest diameter around the illuminating end 30 of the lamp 26. The illuminating end 30 of the lamp 26 typically terminates in a convex dome shape, which generally locates at or near the lower opening of the canister 12 or trim assembly 18, as shown, when the lamp is mounted to the fixture 10. The lamp 26 may be sized so that a gap or space 32 exists between the outer perimeter of the illuminating end 30 and the interior walls of the canister 12 or trim assembly 18, if a trim assembly is employed. The R30 lamp typically has a maximum diameter around its illuminating end of approximately 3.75 inches and the R40 lamp typically has a maximum diameter of at its illuminating end of approximately 5 inches. These incandescent light bulbs are attractive, reasonably priced and have been the standard for use in the recessed canned light fixtures for many years.

Recently, compact fluorescent light bulbs or lamps (CFL) have been gaining popularity due to their higher efficiency and use of less energy and longer life expectancy. The typical CFL is a "swirl" or "twist" shaped bulb. Many find this swirl shape unattractive and unsuitable for use in recessed can light fixtures. Currently, CFL's are made in most common incandescent lamp shapes and in comparative light outputs. To accommodate other shapes, such as the R30 and R40, the swirl-shaped tube of the bulb is encased within a glass or plastic housing of comparable shape to the incandescent light bulbs they are intended to replace. The price of the typical non-encased CFL swirl bulb, at most retail stores, is dramatically less expensive than the encased equivalents. This difference in price makes changing out multiple incandescent R30 or R40 bulbs in recessed can light fixtures for their equivalent-shaped CFLs cost prohibitive for many homes, despite their longevity and energy savings. Some homes have still chosen to place non-encased CFL swirl bulbs in their recessed can light fixtures because of the decreased expense. This is in despite of the cosmetic shortcomings of the bulb compared to the incandescent R30 or R40 lamp that is being replaced.

BRIEF DESCRIPTION OF THE DRAWINGS

For a more complete understanding of the present invention, and the advantages thereof, reference is now made to the following descriptions taken in conjunction with the accompanying figures, in which.

DETAILED DESCRIPTION

Figure 1:
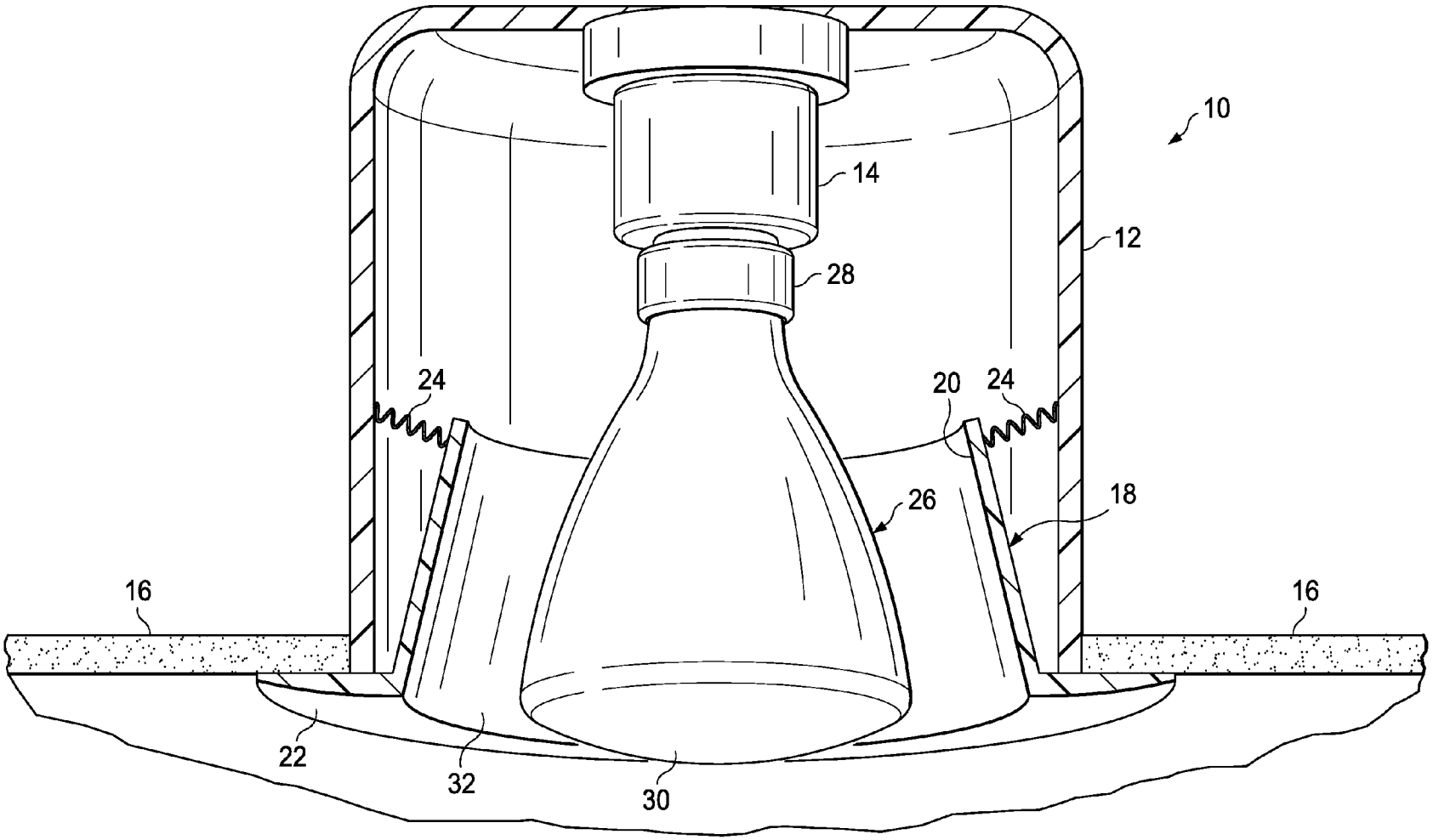
FIG. 1 (PRIOR ART)
FIG. 1 is a cross-sectional side view of a recessed can light fixture employing a R30- or R40-type incandescent lamp as in the prior art.
Figure 2:
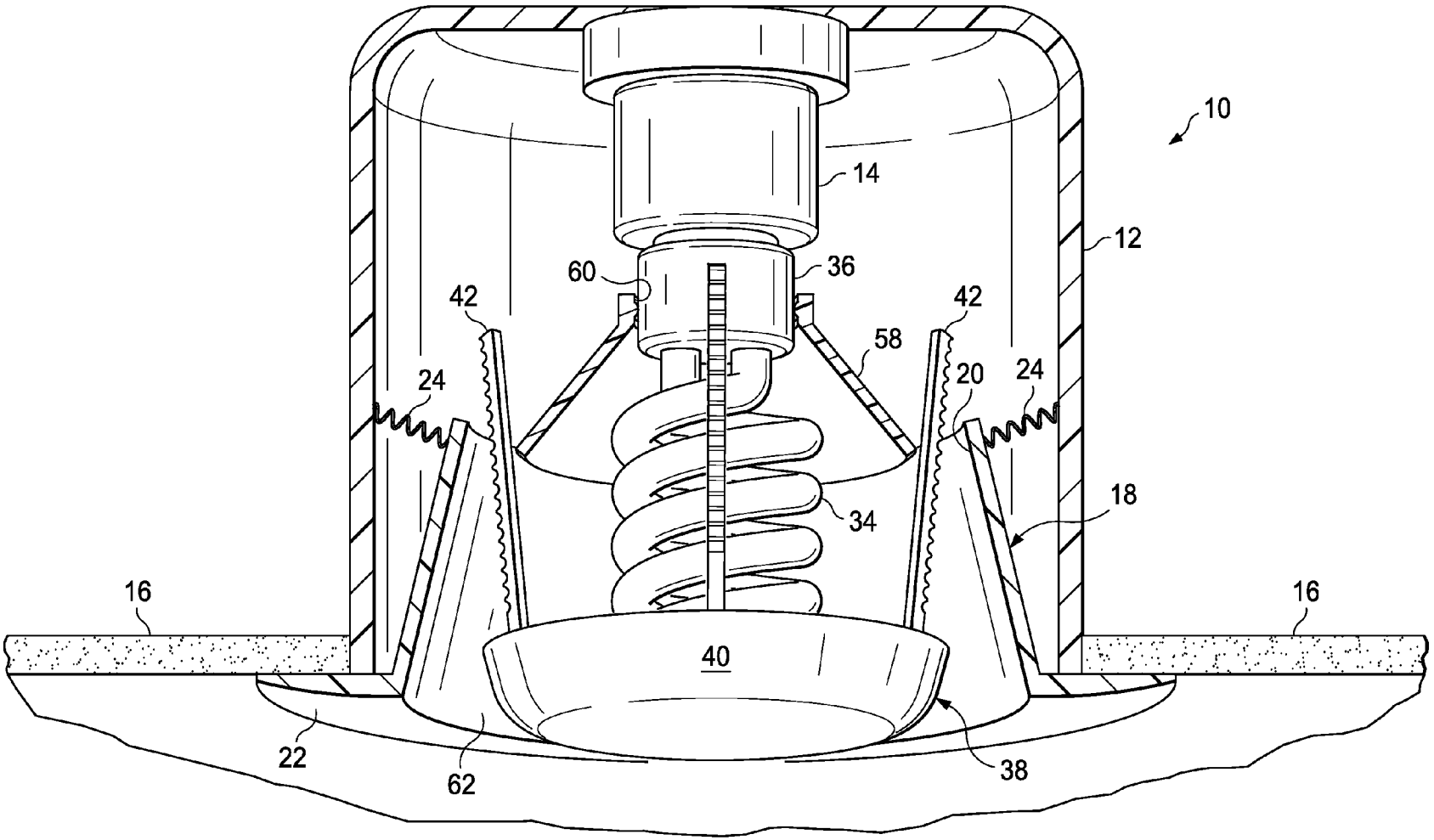
FIG. 2 is a cross-sectional side view of the recessed can light fixture of FIG. 1 employing a swirl-type compact fluorescent lamp and a lamp cover assembly, in accordance with an embodiment of the invention.

Referring to FIG. 2, the recessed can light fixture assembly 10 of FIG. 1 is shown with the incandescent lamp 26 removed and replaced with a swirl-type compact fluorescent lamp or bulb 34. The swirl compact fluorescent bulb 34 has a socket end 36 with a socket that is configured for cooperating with and electrically coupling to the socket 14 of the recessed fixture 10.

A lamp cover assembly 38 is provided with the light fixture assembly 10. The lamp cover assembly 38 provides an attractive appearance for the light fixture assembly 10 when a non-incandescent lamp or bulb is used. Although the lamp cover assembly 38 has particular application with the swirl- or twist-type compact fluorescent bulbs, such as the bulb 34, it may be used with other types of lamps or bulbs, such as LED lights, mercury lamps, etc., as well as incandescent lamps that are not typically employed with recessed can light fixtures, such as the common pear-shaped bulb (A bulb) used with table lamps and the like, which may be less expensive. Other incandescent bulb shapes the lamp cover assembly may be used with that are not typically employed with recessed light fixtures, in addition to that designated as an A bulb, may include those designated in the industry as B, C, F, G, S and T bulbs.

The lamp cover assembly 38 includes a lens body 40. In the embodiment shown, the lens body 40 is configured to approximate the appearance and size of the illuminating end 30 (FIG. 1) of a light bulb typically employed with recessed can light fixtures, when the lamp cover assembly is engaged with the light fixture assembly 10. These include the bulb shapes designated as BR, ER, PAR, K and R, previously discussed. As such, the lens body 40 may be generally dome-shaped or be shaped and sized to approximate the illuminating ends of category BR, ER, PAR, K and R bulbs, such as the R30 and R40 bulbs. Thus, in the case of an R30 configuration, the lens body 40 may have a maximum diameter of approximately 3.75 inches, and in the case of an R40 configuration, the lens body 40 may have a maximum diameter of approximately 5 inches. As shown, the lower face of the lens body 40 is generally convex, while the upper face of the lens body 40 has a corresponding concave shape. As used herein, the expressions "upper," "lower" and similar expressions of orientation are used for purposes of convenience and correspond to the orientation of the elements as they are shown in the accompanying figures. The outer perimeter of the lens body is generally circular, although the lens body may have other shapes as well, such as triangular, rectangular, polygonal, oval, star-shaped, floral, etc., and may include thematic and decorative shapes, which may include geometric or non-geometric shapes.

The lens body 40 is substantially translucent to allow the passage of light through the body 40 while obscuring the view through the lens body. All or a portion of the lens body 40 may be formed from glass, plastic, metal or other suitable material or combination of materials. These may include high temperature resistant plastics, resins, polymers, rubbers, silicone, metals, etc. In many embodiments the body will be a generally clear or white material to provide a white light typical of many lamps. In some embodiments, however, the lens body may be colored or tinted and all or some portions of the lens body may be transparent or opaque to provide a desired appearance or effect.

Figure 3:
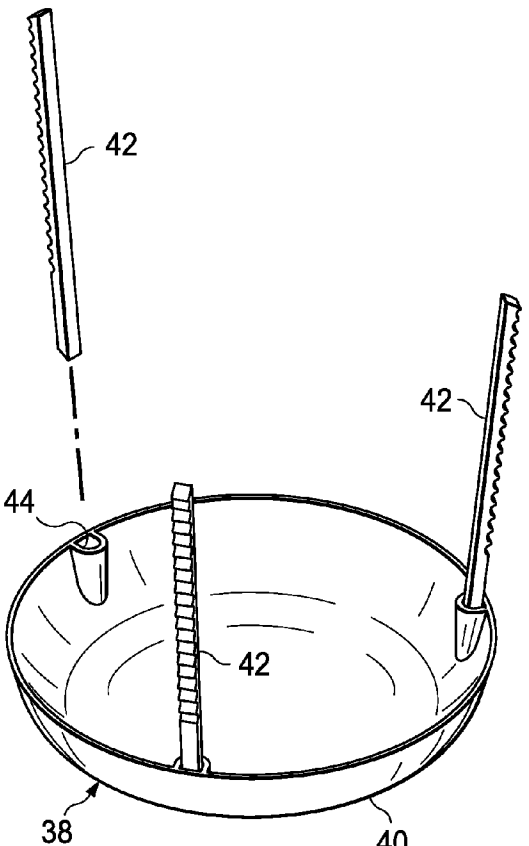
FIG. 3 is a side perspective view of the lamp cover assembly of FIG. 2.

Referring to FIG. 3, the lens body 40 is provided with mounting arms 42. The mounting arms 42 may also be formed high temperature resistant plastics, resins, polymers, rubbers, silicone, etc. or other suitable materials that are capable of carrying out the intended uses and functions as are described herein. The mounting arms 42 may have lengths (e.g. 2-8 inches) sufficient to engage the light fixture 10 to provide the lens body 40 at a location that would approximate the location of the illuminating end 30 of a BR, ER, PAR, K or R light bulb when it is fully coupled within the socket 14 of the fixture 10. Two or more arms may be provided with the lamp cover assembly 38. In the embodiment shown in FIG. 3, there are three mounting arms 42 equally spaced apart around the perimeter. The lower end of the mounting arms 42 are configured to be received within apertures 44 provided or formed in the lens body 40 around the perimeter in a male/female engagement so that the arms 42 are effectively coupled to the body 40. Alternatively, the lower ends of the arms 42 may be provided with apertures for receiving projections or pins (not shown) formed in the lens body 40, in a female/male engagement. Other engagement or fastening means may also be used, as may be known to one skilled in the art. The apertures 44 and lower ends of the mounting arms 42 may be shaped or configured so that the arms 42 may be only received within the apertures 44 in a single orientation to ensure they are properly oriented. A friction, "snap-lock," threaded or other type of engagement may be employed to secure the arms to the lens body 40. The engagement may be releasable or non-releasable. If releasable, the engagement should ensure that the lens body 40 remains in place upon the arms 42 while in normal use. Glue, adhesive, welding, etc. may be used to facilitate a non-releasable engagement. In another embodiment, the mounting arms 42 may be integrally formed with the lens body 40, such as through injecting molding and the like.

Figure 4:
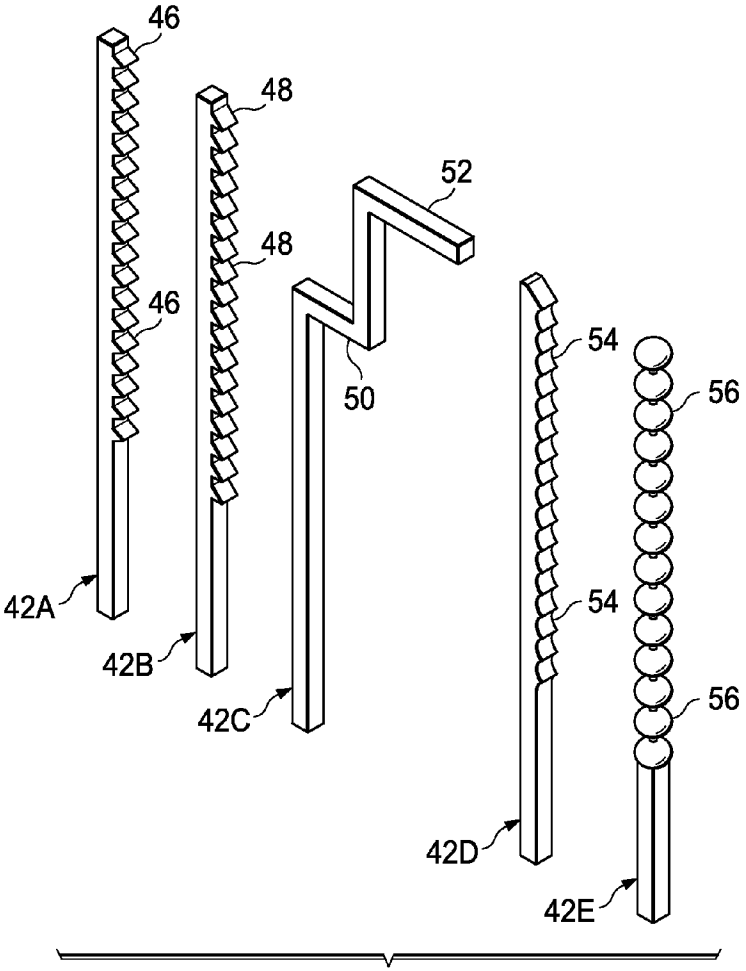
FIG. 4 is a side perspective view of various arms that may be used with the lamp cover assembly.

FIG. 4 shows various configurations for the mounting arms 42, designated as 42A-42E. The arms 42 may carry along at least one side a series of lateral projections along its length to facilitate engagement of the arm with the lighting fixture 10. The arm 42A is provided with bidirectional engaging teeth or projections 46, each tooth or projection having a converging flat, upward-sloped lower surface and a flat, downward-sloped upper surface, relative to a longitudinal axis of the arm 42A. This facilitates both ease of mounting and removal of the arms from the light fixture 10, as will be discussed in more detail later on.

The arm 42B is provided with unidirectional engaging teeth or projections 48, wherein each tooth has a flat, downward-sloped upper surface and a opposite flat surface that is non-sloped or perpendicular to the longitudinal axis of the arm 42B. This facilitates ease of insertion when the arms are moved upwards in the direction of the longitudinal axis of the arm 42B, but may facilitate prevention of removal when moved in the opposite direction.

The arm 42C is provided with two or more stepped projections 50, 52 that are stair-stepped along the upper end of the arm 42C, with the uppermost step 52 projecting laterally outward further than the next lowest projection 50. Additional step projections may also be provided so that there are three or more. The length of each projection may vary. As an example, however, each projection 50 may have a length of from about ¼ inch to about 1 inch and any length in between. This may facilitate coupling to different components of the light fixture 10, wherein engagement of only one of either of the projections 50, 52 is possible, depending upon the configuration of the fixture it is employed with. Other configurations that provide this stair-stepped arrangement may also be provided, such as an F-shaped arm (not shown). Alternatively, only a single projection may be provided, such as an inverted L- or inverted J-shaped arm (not shown).

Provided along the length of the arms 42D are a series of teeth or projections that have converging concave arcuate upper and lower surfaces. Convex upper and lower surfaces may also be provided, and in some embodiments one of the upper and lower surfaces may be convex and the other concave. In some embodiments, only one surface may be arcuate and the other may be substantially flat, which may either sloped or non-sloped. This also may facilitate ease of mounting and/or removal.

The arm 42E is provided with a series of beads 56 along its length, each of which may be generally spherical or spheroidal in shape. In this embodiment the beads 56 provide sloped and arcuate upper and lower surfaces of the projections are provided around the entire perimeter of the arm 42E. Other shaped structures may be used in place of the beads 56, such as conical structures to provide the series of projections that extend about the entire perimeter of the arm 42.

Other configurations may be used for the teeth or projections of the arms 42, as well.

Additionally, the arms 42 may be provided with no teeth or projections. In such instances, the arms merely engage the light fixture through frictional engagement from surface contact of the arms against portions of the light fixture to provide sufficient engagement to hold the cover assembly in place. The arms 42 may also be provided with a non-slip coating, such as a rubber coating, that may facilitate such frictional engagement.

The mounting arms 42 extend generally upright from the upper end of the lens body 40. The mounting arms may be flared or angled outwardly toward their upper or free ends, as shown in FIG. 3. In some embodiments, the upper ends of the mounting arms 42 may be located at a position radially outward from the outermost perimeter of the lens body 40, with the lower ends locating at a position radially inward from the outermost perimeter of the lens body 40. In other embodiments, the mounting arms can be generally vertical with no outward flare. The arms 42 are generally rigid but having sufficient elasticity or flexibility so that the upper or free ends of the arms 42 may be slightly flexed or bent to facilitate mounting and/or removal.

In the embodiment of FIG. 2, an optional reflector cone 58 may be provided with the lens cover assembly 38. The reflector cone 58 may couple to the socket portion 36 of the bulb 34 or to the socket assembly 14 of the light fixture 10. An opening 60 may be provided in the cone 58 for receiving the socket 36 or 14. The opening 60 may be sized to provide a friction-type fit so that it is held in place. The reflector cone 58 is provided with a reflective coating or surface that facilitates the downward reflection of light. The purpose of the downward reflector is higher efficiency of light directed downward through the lens body.

In use, the cover assembly 38 is positioned over a lamp that is coupled to the socket 14 of the light fixture 10. If any reflector cone 58 is provided, this may be installed by slipping it over the socket 14 or 36 prior to mounting the cover assembly 38. If the arms 42 of the cover assembly 38 have not already been coupled to the lens body 40, the arms are inserted into the apertures 44 so that they are securely fastened. The cover assembly 38 is then mounted to the light fixture 10 by inserting the arms 42 into the opening of the cone or baffle 20 of the trim assembly 18 located within the canister 12, holding the lens body 40 generally level. As the upper ends of the arms 42 are inserted, they may engage the interior wall of the cone 20. This causes the arms 42 to flex or bend inward slightly. The elasticity of the arms 42 causes the arms 42 to be outwardly biased. As the cover assembly 38 is inserted into the cone 20, the free ends of the arms 42 may extend above the uppermost edge of the cone 20, as shown in FIG. 2. The teeth or projections, such as the teeth 48, of the arm 42 will engage and disengage from the upper edge of the cone 20 until it is positioned at a desired height. The cover assembly 38 may be inserted until the lens body 40 locates at a position that is typical for the illuminating end of those bulbs appropriately and commonly used with the recessed light fixtures. In such instances, the lens body 40 would typically be located at a position at or near the lower opening of the canister 12. A clearance between the lower end of the bulb 26 and the lens body 40 may also be provided. This clearance may vary, but may range, for example, from ¼ inch to 1 inch or more. Once at rest, the teeth or projections of the arm 42 facilitate holding the arm 42 in place upon the cone 20. This provides the most secure engagement of the cover assembly 38 with the cone 20. If the arms 42 do not extend above the upper edge of the cone 20, the outward bias of the arms 42 may still provide sufficient engagement of the arms with the interior of the cone 20 so that the cover assembly is securely mounted to the fixture 10. It should be noted that although the cover assembly 38 is described and shown as being engaged with a cone 20 of the fixture 10, the cover assembly 38 may also be engaged with the canister or housing 12 or other structures of the recessed light fixture 10. For instance, the arms 42 may be sized and configured so that they engage the interior walls of the canister 12, if no cone 20 or trim assembly 18 is provided.

With the cover assembly 38 in place, the light bulb 34 of the light fixture assembly 10 is generally concealed from view through the opening of the light fixture. As can be seen in FIG. 2, the outer perimeter of the lens body 40 is spaced radially inward from the lower edges of the cone 20 so that a gap or clearance 62 remains between the outer perimeter of the lens body 40 and the interior wall of the cone 20, just like the gap 32 that exists using the conventional bulb 26 of FIG. 1. This gap or clearance may vary, but typically will be from about ¼ inch to about 1 inch, and may facilitate ventilation of the radiant heat produced by the light bulb.

For those cover assemblies 38 with arms 42 employing bidirectional teeth or projections or that have teeth with upwardly sloped lower surfaces, to remove the cover assembly 38, one may simply grasp the lens body 40 and pull downward. The sloped lower surface of the teeth or projections facilitates removal of the cover assembly. Where the arms 42 have unidirectional teeth or projections, one may apply slight inward finger pressure to the arms 42 so that the arms 42 are bent inward slightly and the teeth or projections are disengaged from the cone 20 or other structure of the light fixture 10. The cover assembly 38 can then be removed from the fixture 10.

With the cover assembly 38 mounted in place, the cover assembly 38 provides a similar appearance to those incandescent bulbs commonly used with recessed light fixtures. This allows the swirl CFL, LED or non-incandescent or incandescent lamps or bulbs that are not commonly used with recessed light fixtures to be used while providing the same look and feel as that of typical incandescent lamp or bulb used with such recessed lighting. The cover assembly can be reused and is merely removed and replaced when changing out the bulb.

Figure 5:
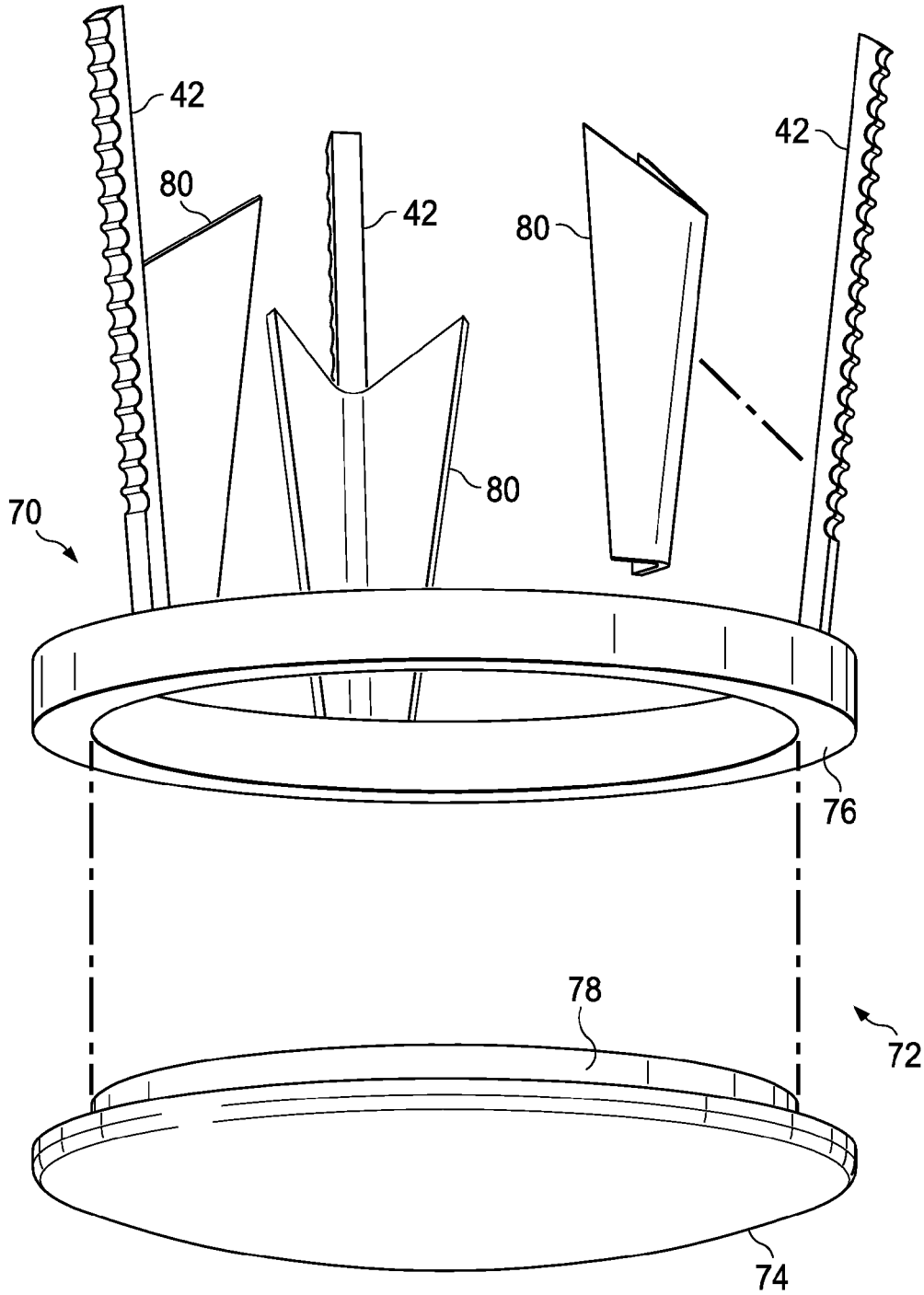
FIG. 5 is a side view of a lamp cover assembly employing a two-piece lens assembly and reflective members, in accordance with an embodiment of the invention.

Referring to FIG. 5, another embodiment of a lamp cover assembly 70 is shown. The cover assembly 70 is similar to the cover assembly 38, with similar components labeled with the same reference numerals. As shown in FIG. 5, the lens body 72 is formed as two separate pieces, with a lens cap 74 of the lens body 72 coupling to a lens cap collar 76 of the lens body 72. The lens cap 74 is provided with a neck 78 that engages and couples to the collar 76. This may be a screw-type, snap-lock or other engagement.

The arms 42 of the cover assembly 70 are coupled or joined to the collar 76. In the embodiment shown, each arm 42 is provided with a reflective member 80 to facilitate reflection of light. Various shapes and configurations may be used for the reflective members 80. In the embodiment shown, the reflectors 80 are wedge- or triangular-shaped members that are bent so that the sides of the wedge are angled inward. These may be coupled to the inward side of the arms, such as through adhesive, welding or other suitable fastening means.

The mounting and removal of the cover assembly 70 to the light fixture 10 is similar to that of the cover assembly 38 previously described.

Figure 6:
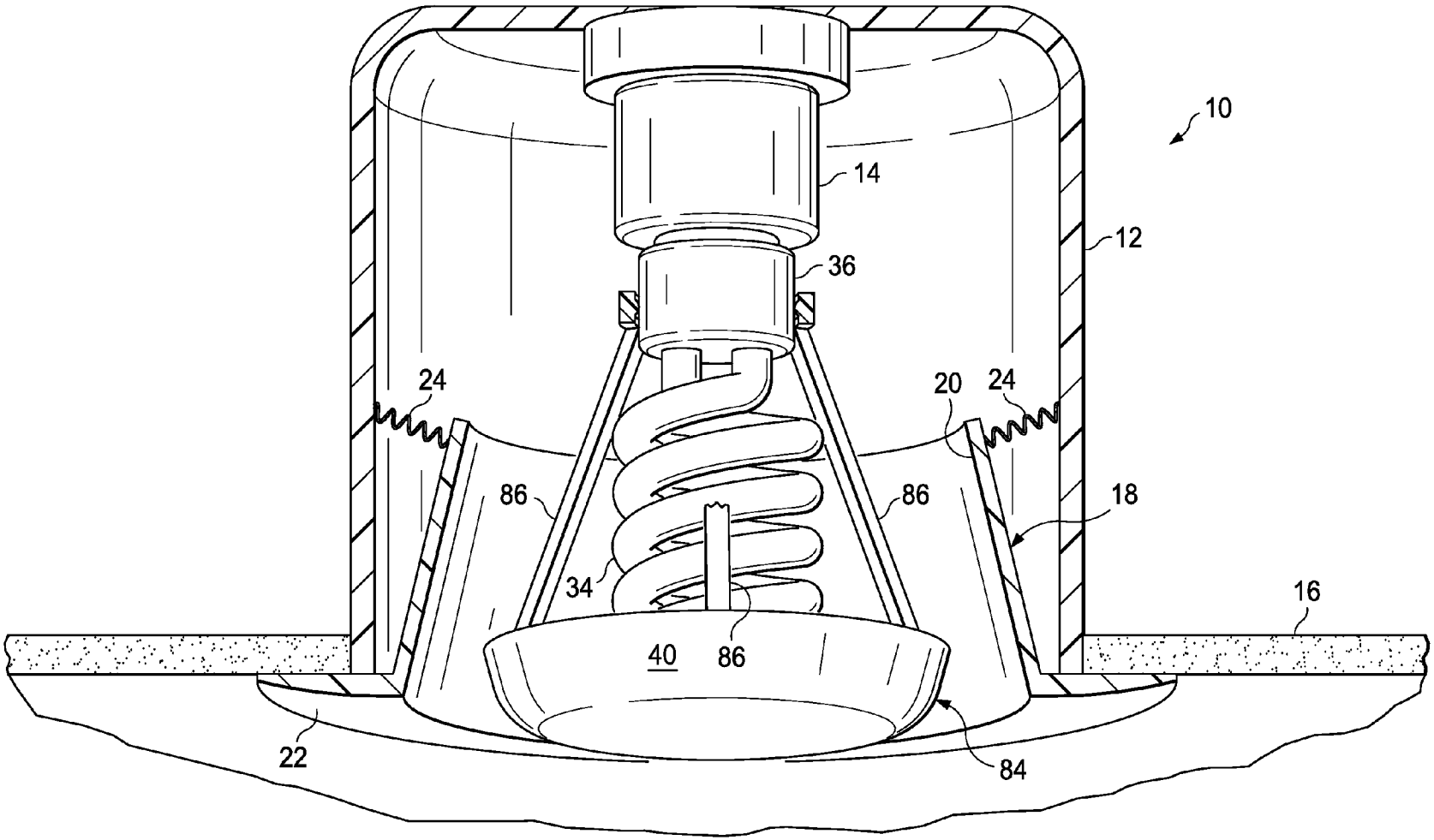
FIG. 6 is a cross-sectional side view of the recessed can light fixture of FIG. 1 employing a swirl-type compact fluorescent lamp and another embodiment of a lamp cover assembly.

FIG. 6 shows still another embodiment of a lamp cover assembly 84. The cover assembly 84 is similar in construction to the cover assemblies 38 and 70, previously described, with similar components labeled with the same reference numerals. In this embodiment, mounting arms 86 of the cover assembly 84 extend upwardly and inwardly from the outer perimeter of the lens body 40 so that the upper ends of the mounting arms 86 engage one of the socket 36 of the bulb 34 or the socket 14 of the fixture 10. The inner surface of the arms 86 may be provided with one or more projections or teeth to facilitate mounting. In this embodiment, the arms 86 may be flexed outwardly slightly to facilitate mounting and so that the elasticity of the arms causes them to be inwardly biased to facilitate holding the cover assembly in place.

While the invention has been shown in only some of its forms, it should be apparent to those skilled in the art that it is not so limited, but is susceptible to various changes and modifications without departing from the scope of the invention. Accordingly, it is appropriate that the appended claims be construed broadly and in a manner consistent with the scope of the invention.

I claim:

1. A method of providing light to an area comprising:

providing a lamp cover assembly for a recessed light fixture assembly having a socket for receiving an electric light bulb, a canister housing for housing the bulb of the light fixture assembly, the canister housing having a lower opening for allowing the passage of light through the lower opening to the area; and wherein the lamp cover assembly has a lens body that is substantially translucent to allow the passage of light through the body and is configured to cover the lower opening so that the light bulb of the light fixture assembly is generally concealed from view through the lower opening, the lamp cover having a light fixture engagement portion that engages the light fixture assembly so that the lamp cover may be selectively engaged and disengaged from the light fixture assembly, with the lens body being generally level and locating at a position at or near the lower opening of the canister housing.

2. The method of claim 1, wherein:

the outer perimeter of the lens body is non-circular and is at least one of a triangular, rectangular, polygonal, oval, star, floral, thematic or decorative shape.

3. The method of claim 1, wherein:

the light bulb is a non-incandescent light bulb.

4. The method of claim 1, wherein:

the engagement portion comprises at least one arm that extends within the canister and is configured for engaging the light fixture assembly.

5. The method of claim 4, wherein:

the at least one arm and lens body of the lamp cover are configured for releasable engagement with one another.

6. The method of claim 4, wherein:

the at least one arm is provided with a series of projections along the length of the arm to facilitate engagement of the arm with the light fixture assembly.

7. The method of claim 1, wherein:

the light cover assembly is provided with a reflective member for reflecting light through the body of the lamp cover assembly.

8. The method of claim 1, wherein:

the light fixture assembly comprises a trim assembly, and wherein the light fixture engagement portion engages the trim assembly.

9. The method of claim 8, wherein:

the trim assembly has a cone that is received within the canister housing, and wherein the light fixture engagement portion engages the cone of the trim assembly.

10. The method of claim 1, wherein:

wherein at least portions of the lens body are at least one of tinted, colored, opaque or transparent.

11. The method of claim 1, wherein:

wherein the body of the lamp cover assembly has an outer perimeter that is spaced radially inward a distance from the edges of the lower opening of the light fixture assembly when the cover is engaged with the light fixture assembly.

12. A lamp cover assembly for a recessed light fixture assembly having a socket for receiving an electrical light bulb, a canister housing for housing the bulb of the light fixture assembly, the canister housing having a lower opening for allowing the passage of light through the lower opening, the lamp cover assembly comprising:

a lens body that is substantially translucent to allow the passage of light through the body and is configured to cover the lower opening so that the light bulb of the light fixture assembly is generally concealed from view through the lower opening, the lens body being generally level and locating at a position at or near the lower opening of the canister housing; and a light fixture engagement portion for engagement with the light fixture assembly so that the lamp cover may be selectively engaged and disengaged from the light fixture assembly, the engagement portion comprising at least one arm configured for extending within the canister and for engaging the light fixture assembly.

13. The lamp cover assembly of claim 12, wherein:

the outer perimeter of the lens body is non-circular and is at least one of a triangular, rectangular, polygonal, oval, star, floral, thematic or decorative shape.

14. The lamp cover assembly of claim 12, wherein:

the body of the lamp cover assembly has an outer perimeter that is sized so that at least portions of the perimeter are spaced radially inward a distance from the edges of the lower opening of the light fixture assembly when the cover assembly is engaged with the light fixture assembly.

15. The lamp cover assembly of claim 12, wherein:

the at least one arm and lens body of the lamp cover assembly are configured for releasable engagement with one another.

16. The lamp cover assembly of claim 12, wherein:

the at least one arm is provided with a series of projections along the length of the arm to facilitate engagement of the arm with the light fixture assembly.

17. The lamp cover assembly of claim 12, wherein:

the light cover assembly is provided with a reflective member for reflecting light through the body of the lamp cover assembly.

18. The lamp cover assembly of claim 12, wherein:

the light fixture assembly comprises a trim assembly having a cone that is received within the opening, and wherein the light fixture engagement portion engages the cone of the trim assembly.

19. The lamp cover assembly of claim 12, wherein:

the lens body of the lamp cover assembly is configured in size and shape to approximate the appearance of the illuminating end of a light bulb when engaged with the light fixture assembly.

20. The lamp cover assembly of claim 12, wherein:

wherein at least portions of the lens body are at least one of tinted, colored, opaque or transparent.

21. A lamp cover assembly for a recessed light fixture assembly having a socket for receiving an electrical light bulb, a canister housing for housing the bulb of the light fixture assembly, the canister housing having a lower opening for allowing the passage of light through the lower opening, the lamp cover assembly comprising:

a lens body that is substantially translucent to allow the passage of light through the body and is configured to cover the lower opening so that the light bulb of the light fixture assembly is covered by the lens body, the lens body being generally level and locating at a position at or near the lower opening of the canister housing; and a light fixture engagement portion for engagement with the light fixture assembly so that the lamp cover may be selectively engaged and disengaged from the light fixture assembly.

* * * * *